US005797323A

United States Patent [19]

Beck

[11] Patent Number: 5,797,323

[45] Date of Patent: Aug. 25, 1998

[54] PRINTING CYLINDER FOR A PRINTING PLATE MADE OF A MAGNETIZABLE CARRIER MATERIAL

[75] Inventor: Rolf Beck, Pliezhausen, Germany

[73] Assignee: Kocher + Beck GmbH & Co., Pliezhausen, Germany

[21] Appl. No.: 783,002

[22] Filed: Jan. 14, 1997

[30] Foreign Application Priority Data

Jan. 26, 1996 [DE] Germany ..... 196 02 746.2

[51] Int. Cl.[6] ..... B41F 27/00

[52] U.S. Cl. ..... 101/389.1; 101/378

[58] Field of Search ..... 101/389.1, 378

[56] References Cited

U.S. PATENT DOCUMENTS 3,721,189 3/1973 Bray ..... 101/382 MV 3,858,287 1/1975 Christoffersen ..... 101/155

5,357,863 10/1994 McLean et al. ..... 101/389.1

5,627,505 5/1997 Iwaszek ..... 335/302

FOREIGN PATENT DOCUMENTS 2 165 489 4/1986 United Kingdom .

*Primary Examiner*—Edgar S. Burr

*Assistant Examiner*—Dave A. Ghatt

*Attorney, Agent, or Firm*—Evenson, McKeown, Edwards & Lenahan, P.L.L.C.

[57] ABSTRACT

In the case of a printing cylinder for a printing plate made of a magnetizable material, a roller-shaped basic body is provided which, on its circumference, has an axial slot for the hanging-in of a bent edge of the start of the printing plate and several holding magnets distributed along the circumference, one wall of the slot being formed of a strip made of a magnetizable material which, inside the slot, is provided with holding magnets used for holding the bent edge of the printing plate.

17 Claims, 1 Drawing Sheet

PRINTING CYLINDER FOR A PRINTING PLATE MADE OF A MAGNETIZABLE CARRIER MATERIAL

BACKGROUND AND SUMMARY OF THE INVENTION

This invention relates to a printing cylinder for a printing plate or block made of a magnetizable carrier material, having a roller-shaped basic body which is provided on its circumference with a slot for hanging in a bent edge of the start of the printing plate, with several holding magnets distributed along the circumference, and with a holding magnet for the end of the printing plate and adjacent to the slot, which holding magnet extends approximately along the whole axial length of the basic body.

The basic body of a printing cylinder normally consists of aluminum or of an aluminum alloy. It can be constructed as a massive body to which shaft stubs are molded. However, it can also be a hollow cylinder which is connected with shaft stubs and driving elements or is fitted onto a shaft. Normally, the printing blocks or plates are made of a plastic foil which is coated with a photo polymer which is exposed and etched corresponding to the desired printed format. The printing plate is glued onto the basic body in a whole-surface manner by means of a double-sided adhesive tape. The exchange of such a printing block is therefore very time-consuming.

It is also known to provide a magnetizable carrier material for the printing plate, particularly a tin plate, which is coated with the photo polymer. The start of the printing plate is provided with a bent edge by means of which the printing block is hung into an axially extending and radially aligned slot of the basic body. In the known construction, holding magnets are arranged on both sides of the slot and in its immediate vicinity, which holding magnets extend approximately along the whole length of the basic body in the axial direction. These holding magnets consist of individual magnet elements which, with a changing polarity, are threaded onto a rod and are glued into recesses of the basic body. A plurality of additional holding magnets of this type are distributed along the circumference of the basic body and extend also approximately along the whole length of the basic body. In the case of this construction, the exchanging of a printing plate can be carried out faster than the exchanging of printing plates having a carrier material made of plastic. However, it is very difficult to thread the bent edge of the start of the printing block securely into the slot because this bent edge is subjected to the influence of the holding magnets arranged on both sides of the slot.

It is an object of the invention to provide a printing cylinder of the initially mentioned type which permits an easy exchange of a printing plate.

This object is achieved in that a wall of the slot is formed of a strip which within the slot is provided with holding magnets used for holding the bent edge of the printing plate.

Because of this construction, a holding magnet is not required which is adjacent to the slot and assigned to the start of the printing plate so that only the holding magnet assigned to the end of the printing plate exists in the immediate vicinity of the slot. The holding magnets arranged inside the slot in a strip also facilitate the threading of the bent edge into the slot, this bent edge also being pulled into the slot. After the bent edge is threaded into the slot, the start of the printing plate is held with a relatively high force so that, when placed around the basic body of the printing cylinder, the printing plate can be tensioned and smoothed with a correspondingly high force. As the result, a very simple and mainly fast exchanging of a printing plate is achieved which, in addition, is held very securely on the basic body of the printing cylinder.

In a further development of the invention, it is provided that the strip consists of a magnetizable material. As a result, an advantageous distribution of the magnetic lines of flux is obtained so that, by means of relatively small magnets, a relatively high force is obtained by means of which the bent edge is pulled into the slot and is held in the slot.

In the case of an advantageous embodiment, it is provided that the strip is a steel strip which is held in an adhering manner in the basic body made of aluminum or of an aluminum alloy. In addition, the steel strip has the advantage that the edge of the slot around which the printing plate is pulled, consists of a material which has a clearly higher stability than the material of the basic body.

In a further development of the invention, it is provided that the slot and the strip form, by means of a tangent placed on the circumference of the basic body in the area of the slot, an angle which is acute with respect to the rotating direction. This slot, which is therefore directed diagonally against the rotating direction, has the result that during the placing, the bent edge of the printing plate is hardly stressed by forces which could cause the edge to move out of the slot.

In a further development of the invention, it is provided that, at a distance from the slot, a holding magnet is arranged which is assigned to the start of the printing plate and extends in the axial direction approximately along the length of the basic body. This holding magnet is arranged at a sufficient distance to the slot so that it does not influence the threading. However, it provides that the printing plate is securely pulled toward the basic body and placed on it at a not very large distance from the bent edge so that, on the whole, a secure contact of the printing plate is ensured.

In a further development of the invention, it is provided that another holding magnet is arranged in parallel to the holding magnet assigned to the end of the printing plate, which other holding magnet extends approximately along the whole axial length of the basic body. Thus, it is ensured that the printing plate is held in the area of its end by means of particularly strong forces.

In a further development of the invention, it is provided that, between the holding magnets assigned to the start and the end of the printing plate, holding magnets are mounted which are uniformly distributed along the circumference and which each extend essentially only along the area of the longitudinal center of the basic body. Since the printing plate is securely held in the area of its start and of its end, the holding magnets arranged in a distributed fashion in the remaining area are used essentially only as mounting aids, while their function is not required during the printing. As a result, it is possible to reduce the number of these holding magnets and to also shorten the axial length of these holding magnets.

In a further development of the invention, it is provided that the holding magnets for the start and/or the end of the printing plate and/or the holding magnets arranged in-between distributed along the circumference of the basic body and/or the magnets of the strip consist of rare earth metals. These magnets cause very strong magnetic forces and also have the advantage that they represent one-piece elements which as such can be inserted and glued into recesses of the basic body.

Other objects, advantages and novel features of the present invention will become apparent from the following detailed description of the invention when considered in conjunction with the accompanying drawings.

DETAILED DESCRIPTION OF THE DRAWINGS

Figure 1:
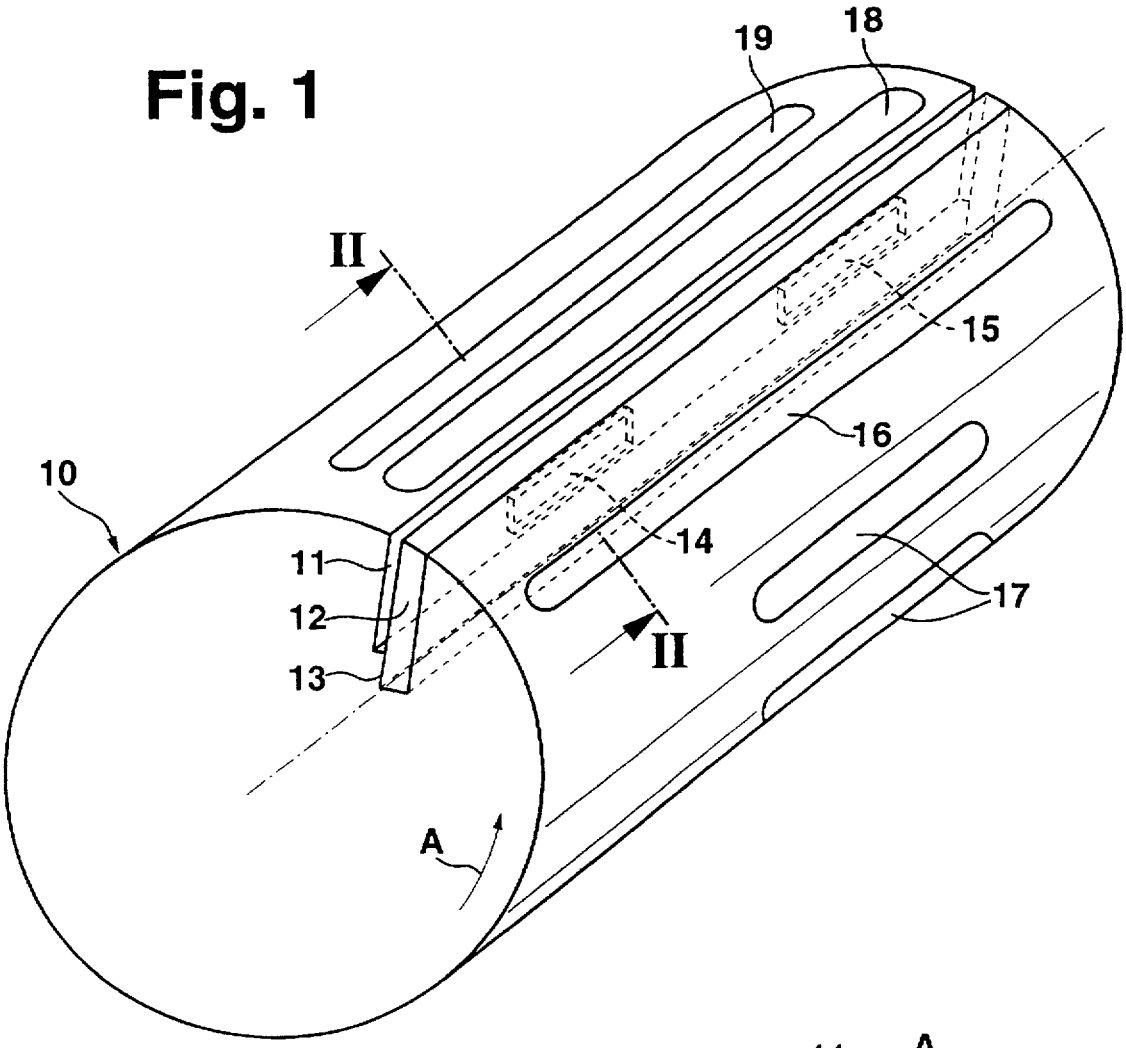
FIG. 1 is a perspective view of a basic body of a printing cylinder according to the invention.

The basic body 10 illustrated in FIG. 1 is constructed as a massive roller which is made of aluminum or of an aluminum alloy. For completing the basic body 10 to form a printing cylinder, axle stubs or shaft stubs must be provided on both end faces of the basic body. These can be produced in one piece with the basic body 10 or may be separate structural members which are connected with the basic body, for example, by screws or other coupling elements. Likewise, it is possible to construct the basic body 10 as a cylindrical hollow body which is fitted onto an axle or shaft and is non-rotatably connected with it.

The basic body 10 is used for receiving a printing block or plate which has a magnetizable carrier material, for example, tin plate. At its start, this printing plate is provided with a bent edge by means of which it is hung into a slot 11 of the circumference of the basic body 10 which extends in the axial direction along the whole length of the basic body 10. The slot 11 has a width which is slightly larger than the thickness of the bent edge of the printing plate. On its bent edge, the printing plate is hung into the slot, after which the printing plate is wound around the circumference of the drum until its end comes to rest in the direct proximity of the slot 11.

The side wall of the slot which faces the start of the printing plate is formed of a strip 12 which extends along the whole axial length of the basic body 10. The strip 12 is inserted and glued into a groove 13 of the basic body 10.

The strip 12 consists of a magnetizable material, preferably steel. Two or several magnets 14, 15 are embedded into this strip 12, are situated in the slot 11 and extend flush to the side wall of the slot 11 formed by the strip 12. At a relatively large distance to the slot 11 and the strip 12, which amounts to 20 mm or more, a holding magnet 16 is inserted into the circumference of the basic body 10 and extends approximately along the whole axial length of the basic body 10 in the axial direction. Additional holding magnets 17 follow at regular distances and are uniformly distributed along the circumference. The holding magnets 17 have a relatively short axial dimension, that is, approximately ¼ to ⅓ of the holding magnet 16, and are arranged only in the area of the longitudinal center plane of the basic body 10.

In the immediate vicinity of the slot 11, a holding magnet 18 is inserted into the basic body 10 on the side opposite the strip 12, which holding magnet 18 extends in parallel to the slot 11 and essentially along the whole axial length of the basic body 10. In parallel to the holding magnet 18, another holding magnet 19 is arranged at a narrow distance, for example, at a distance of not more than 10 mm, which also extends approximately along the whole axial length of the basic body 10.

The holding magnets 14, 15, 16, 17, 18 and 19 are made of rare-earth metals. They are each inserted as a uniform body into the prepared receiving devices of the strip 12 and of the basic body 10 and are held in them by means of an adhesive. After the inserting of the holding magnets 16, 17, 18, 19, the basic body 10 is ground cylindrically on the outside.

Figure 2:
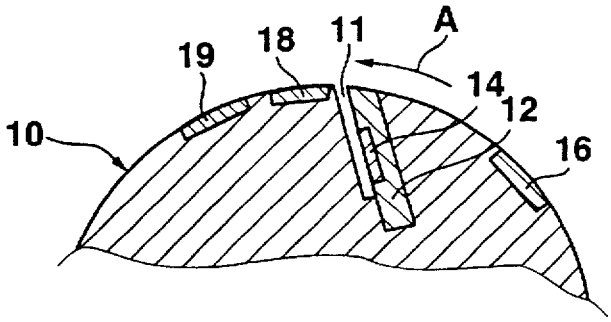
FIG. 2 is a partial sectional view along Line II—II of FIG. 1.
Figure 3:
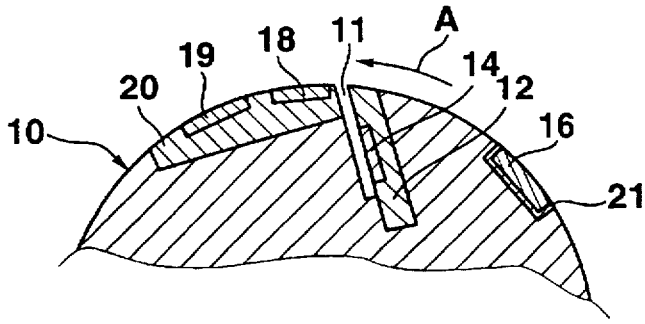
FIG. 3 is a partial sectional view similar to FIG. 2 of another embodiment of a basic body of a printing cylinder.

As illustrated particularly in FIG. 2 and also in FIG. 3, the slot 11 and therefore also the strip 12 extend diagonally to the radial line of the basic body 10 in such a manner that, in the rotating direction (A), an acute angle is obtained between a tangent of the printing cylinder placed in the area of the slot 11 and the slot walls, which acute angle measures from 10° to 60°, and preferably less than 45°.

When a printing plate is applied, its bent edge is threaded into the slot 11. The threading is relatively simple because a holding magnet is arranged only on one side of the slot 11, specifically the holding magnet 18. The holding magnets 14 and 15 situated within the slot 11 and inserted into the strip 12 promote the threading-in and mainly pull the bent edge of the start of the printing plate into the slot 11. In this case it is expedient for the holding magnets 14, 15 to be arranged so deep in the slot 11 that the end of the bent edge of the printing plate comes to be situated in the area of these holding magnets 14, 15 and does not protrude beyond them. After the introduction of the bent edge into the slot 11, the printing plate is placed around the basic body against the direction of the arrow (A). In this case, the holding magnet 16 which is assigned to the start of the printing plate first takes over the printing block. The holding magnets 17 facilitate the mounting and the smooth applying of the printing plate to the basic body 10 of the printing cylinder. Finally, the holding magnets 18, 19 receive the end of the printing plate which is therefore held securely and directly adjoins the slot 11.

In the embodiment according to FIG. 3, it is provided that the two holding magnets 18, 19 assigned to the end of a printing plate are arranged in an insert 20 which is inserted in a recess of the basic body 10 and which extends along its whole axial length. The insert 20 consists of a magnetizable material, particularly steel. The insert 20 forms the side wall of the slot 11 situated opposite the strip 12. This results in the advantage that both exterior edges of the slot 11 consist of a relatively firm material, particularly of steel, so that they are largely protected from mechanical damage. In addition, the insert 20 allows a better distribution of the magnetic lines of the holding magnets 18, 19 so that it is possible to guide the end of the printing plate virtually directly to the slot 11 and still hold it there securely.

In the embodiment according to FIG. 3, it is provided for increasing the holding effect that the holding magnet 16 is inserted, for example, glued into a U-shaped insert 21 made of a magnetizable material which, in turn, is inserted into the basic body 10. For this purpose, a U-profile made of steel can be used, for example, which has a thickness of from 1 mm to 2 mm and which is edged from sheet metal. Such inserts made of a magnetizable material are also useful for the holding magnets 16, 17, 18 and 19 of the embodiment according to FIG. 1 and 2. Such inserts are naturally not necessary if the basic body 10 is made of a magnetizable material, such as steel tube.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A printing cylinder for a printing plate made of a magnetizable carrier material, having:

a roller-shaped basic body which is provided on its circumference with a slot for receiving a bent edge of the start of the printing plate, with at least two circumferential holding magnet distributed along the circumference, and at least one end holding magnet for the end of the printing plate adjacent to the slot, said at least one end holding magnet extending approximately along the whole axial length of the basic body, the slot having a wall formed from a strip, the strip being provided with the at least one holding magnet for holding the bent edge of the printing plate.

2. A printing cylinder according to claim 1, wherein the strip consists of a magnetizable material.

3. A printing cylinder according to claim 2, wherein the strip is a steel strip which is held by an adhesive to the basic body made of aluminum or of an aluminum alloy.

4. A printing cylinder according to claim 1, wherein a plurality of end holding magnets are provided which are glued into recesses of the strip flush with the wall facing the slot.

5. A printing cylinder according to claim 1, wherein the slot and the strip, together with a tangent placed on the circumference of the basic body next to the slot, form an acute angle with respect to a rotating direction of the cylinder during printing operations.

6. A printing cylinder according to claim 1, wherein one of said circumferential holding magnets is assigned to the start of the printing plate and extends in the axial direction along the length of the basic body is arranged at a distance from the slot.

7. A printing cylinder according to claim 1, wherein another of said circumferential holding magnets is arranged which extends along the length of the basic body in parallel to the circumferential holding magnet assigned to the end of the printing plate.

8. A printing cylinder according to claim 1, wherein, between respective circumferential holding magnets assigned to the start and the end of the printing plate, further circumferential holding magnets are arranged which are uniformly distributed along the circumference and which each extend only along an area of the longitudinal center of the basic body.

9. A printing cylinder according to claim 1, wherein the at least one end holding magnet is arranged in said strip which is made of a magnetizable material which is imbedded in the basic body.

10. A printing cylinder according claim 1, wherein at least one of the circumferential holding magnets is surrounded by means of an insert on the magnetizable material.

11. A printing cylinder according to claim 1, wherein at least one of the holding magnets consists of rare-earth metals.

12. A printing cylinder assembly for holding a printing plate made of a magnetizable carrier material, comprising:

a roller shaped basic body, an axially extending slot along a circumferential surface of the basic body configured to engage a bent edge of a printing plate which is held on the circumferential surface during printing operations, and at least one bent edge holding magnet disposed inside said slot for holding the bent edge of a printing plate, wherein said at least one bent edge holding magnet is embedded in a strip which forms one side wall of said slot.

13. A printing cylinder assembly according to claim 12, wherein two of said at least one bent edge holding magnets are disposed inside said slot axially spaced from one another.

14. A printing cylinder assembly according to claim 12, wherein said strip is made of magnetizable material.

15. A printing cylinder assembly according to claim 12, further comprising a plurality of plate holding magnets embedded in said circumferential surface.

16. A printing cylinder assembly according to claim 12, wherein the basic body is made of one of aluminum and an aluminum alloy, and wherein said at least one bent edge holding magnet is embedded in a steel strip forming a side wall of said slot.

17. A printing cylinder for a printing plate made of a magnetizable carrier material, having:

a roller-shaped basic body which is provided on its circumference with a slot for receiving a bent edge of the start of the printing plate, with a plurality of circumferential holding magnets distributed along the circumference including a circumferential holding magnet for the end of the printing plate adjacent to the slot, said plurality of holding magnets extending along the axial length of the basic body, the slot having a wall formed from a strip, the strip being provided with end holding magnets for holding the bent edge of the printing plate inserted into said slot.

* * * * *

UNITED STATES PATENT AND TRADEMARK OFFICE

CERTIFICATE OF CORRECTION

PATENT NO. : 5,797,323
DATED : August 25, 1998
INVENTOR(S) : Beck

It is certified that error appears in the above-identified patent and that said Letters Patent is hereby corrected as shown below:

Title page,
Item [73], please change the name of the assignee from "Kocher + Beck GmbH & Co." to -- Kocher + Beck GmbH + Co. Rotationsstanztechnik KG --

Signed and Sealed this

Twenty-ninth Day of June, 2004

JON W. DUDAS
*Acting Director of the United States Patent and Trademark Office*